United States Patent [19]

Mori et al.

[11] Patent Number: 4,728,206

[45] Date of Patent: Mar. 1, 1988

[54] PRINTING CONTROL DEVICE AND METHOD

[75] Inventors: Isao Mori; Hisaki Okada, both of Aichi, Japan

[73] Assignee: Brother Kogyo Kabushiki Kaisha, Nagoya, Japan

[21] Appl. No.: 853,152

[22] Filed: Apr. 17, 1986

[30] Foreign Application Priority Data

Apr. 19, 1985 [JP] Japan ..... 60-59423[U]

[51] Int. Cl.[4] ..... B41J 33/34; B41J 33/36

[52] U.S. Cl. ..... 400/225; 400/232

[58] Field of Search ..... 400/225, 232, 234, 229

[56] References Cited

U.S. PATENT DOCUMENTS 4,000,804 1/1977 Zaltieri ..... 400/225 X
4,632,582 12/1986 Houston ..... 400/232
4,640,635 2/1987 Nakai ..... 400/225 X

FOREIGN PATENT DOCUMENTS 194593 11/1983 Japan ..... 400/225
44385 3/1985 Japan ..... 400/225

OTHER PUBLICATIONS

*IBM Tech. Disc. Bulletin*, by S. U. Blaskovic, vol. 21, No. 2, Jul. 1978, pp. 448–449.

*Primary Examiner*—Paul T. Sewell
*Attorney, Agent, or Firm*—Finnegan, Henderson, Farabow, Garrett and Dunner

[57] ABSTRACT

A printing device in which a printing ribbon moves in one direction and a printing head moves back and forth parallel to the ribbon. When the head and ribbon move in the same direction, printing is not started until the ribbon is moving at a faster speed than the head. When the head and ribbon move in opposite directions, printing is not started until the ribbon is moving at a given speed which is a fraction of the speed of the head.

4 Claims, 7 Drawing Figures

PRINTING CONTROL DEVICE AND METHOD

BACKGROUND OF THE INVENTION

The present invention relates to a printing device in which characters or the like are printed on a printing sheet through a printing ribbon while a printing head is moved along the printing line.

Heretofore, in printing devices in which a two-way printing operation is carried out in association with the forward and backward movement of the printing head, when the printing head is moved forwardly, the printing ribbon is moved slightly in the direction opposite to the direction of movement of the printing head. The printing ribbon extended along the printing line is thus tightened. When the printing head is moved backwardly, the printing ribbon is moved in the direction opposite to the direction of movement of the printing head at a speed higher than the speed of movement of the head. An unused part of the printing ribbon is thus at the printing position at all times. This method eliminates low quality printing characters caused by slackened printing ribbon in the forward movement of the printing head and eliminates blurred characters caused by the used part of the printing ribbon being repeatedly struck in the backward movement of the printing head.

In the conventional printing device in which the printing ribbon is run as described above, the torque of the printing ribbon driving motor is smaller than that of the printing head driving motor. Therefore, when the printing head is moved backward in the same direction as the ribbon, the ribbon is moved faster than the printing head. As shown in FIG. 6, the rise time t2 required for the speed of the printing ribbon to reach a predetermined value is longer than the rise time t1 required for the speed of the printing head to reach a predetermined value. Accordingly, if when the speed of the printing head reaches the predetermined value, the printing operation is started, there is a period of time in which the speed of the printing ribbon is substantially equal to the speed of the printing head (as indicated by the shaded region in FIG. 6). The same part of the printing ribbon is therefore being repeatedly struck. As a result, the printed characters or the like are not clear, or of bad quality.

SUMMARY OF THE INVENTION

In view of the foregoing, it is an object of the present invention to provide a printing device in which, when the printing head and the printing ribbon are moved in the same direction and the printing ribbon is moved faster than the printing head, the start of the printing operation is so timed that an unused part of the printing ribbon comes to the printing position at all times, and the characters or the like are printed clearly.

In accordance with the above objects, there has been provided a printing device comprising a printing ribbon and a printing head for impacting the ribbon incident to a printing operation. The device also includes printing head drive means for reciprocating the printing head along a line in first and second directions. The head reciprocates at a first speed. Ribbon driving means are provided for moving the ribbon in the second direction at a second speed. Control means are provided for starting the printing operation according to a first parameter. The first parameter includes the printing head moving in the second direction and the second speed being greater than the first speed.

Also, according to the present invention the control means may start the printing operation according to a second parameter. The second parameter includes the printing head moving in the first direction and the second speed being a fraction of the first speed.

A method for operating a printing device is also provided according to the above objects. The process according to the invention comprises the following steps:

(a) the printing head is selected to move along a line in either a first direction or a second direction;

(b) if first direction is selected, first movement data is accessed for moving the ribbon at a second speed;

(c) after step (b), the ribbon driving means are started for driving the ribbon in the second direction at the second speed;

(d) a first predetermined time period after step (c), printing head driving means are started for driving the printing head in the first direction at a first speed faster than the second speed;

(e) after step (d), and when the ribbon is moving, a printing operation is started in which the printing head impacts the ribbon;

(f) either step (a) is repeated or the printing device is stopped;

(g) if the second direction is selected in step (a), second movement data is accessed for moving the ribbon at a third speed which is faster than the first speed;

(h) after step (g), the ribbon driving means are started for driving the ribbon in the second direction at the third speed;

(i) the first predetermined time period after step (h), the printing head driving means are started for driving the printing head in the second direction at the first speed;

(j) after step (i), the printing operation is started in which the printing head impacts the ribbon; and (k) either step (a) is repeated, or the printing device is stopped.

Further objects, features and advantages of the present invention will become apparent from the following brief description of preferred embodiments and attached figures of drawing.

BRIEF DESCRIPTION OF THE PREFERRED EMBODIMENTS

The objects of the present invention have been achieved by providing a printing device in which a printing head is reciprocated along the printing line, and characters or the like are printed on a printing sheet while a printing ribbon is moved in a predetermined direction in association with the reciprocation of the printing head. The device according to the invention comprises printing head driving means for reciprocating the printing head at a predetermined speed; ribbon driving means for moving the printing ribbon at a speed different from the speed of the printing head; and control means for controlling the start of a printing operation so that, when the printing head and the printing ribbon move in the same direction, the ribbon is moved faster than the printing head.

According to the present invention, the printing ribbon run by the ribbon driving means runs at a speed different from the speed of the printing head driven by the printing head driving means. When the printing head and the printing ribbon move in the same direction, the printing operation is started at a point where the speed of the ribbon is higher than the speed of the head. Accordingly, when the printing ribbon is moved faster than the printing head, the unused part of the printing ribbon comes to the printing position at all times. This eliminates blurring of the printed characters or the like when the same part of the printing ribbon is repeatedly struck. Thus, with the printing device according to the present invention, characters or the like can be clearly printed at all times.

Figure 1:
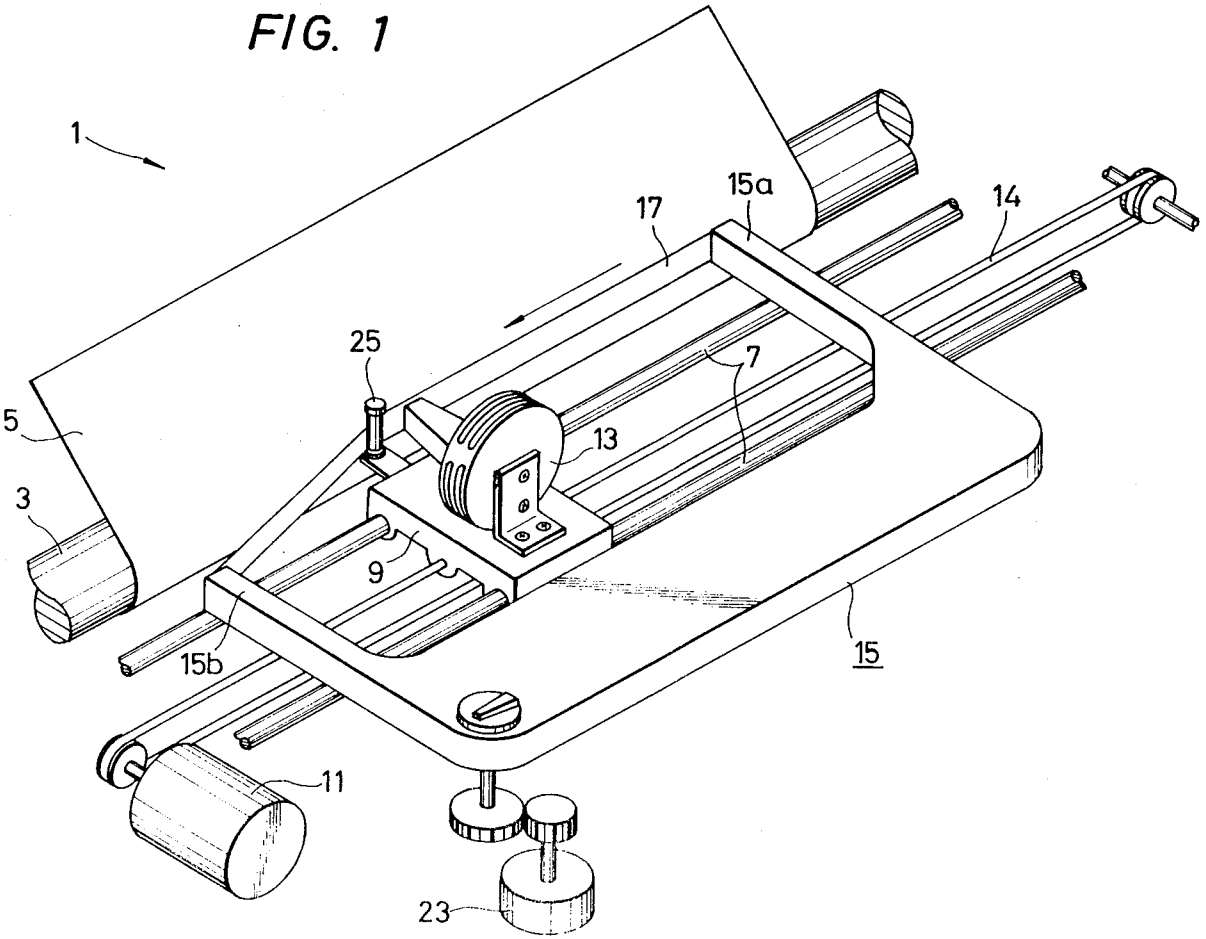
FIG. 1 is a perspective view outlining the construction of a printer.

FIG. 1 outlines the construction of an impact-type dot printer in which the technical concept of the present invention is applied. As shown in FIG. 1, a platen 3 is rotatably supported between a pair of frames (not shown) of the printer 1. The platen 3 is coupled to a platen driving motor (not shown) such as a DC motor or step motor. As the platen driving motor is rotated, a printing sheet 5 wound on the platen 3 is fed in a desired direction. Two carriage guides 7 are extended between the two frames in such a manner that they are parallel to the platen 3. A carriage 9 is mounted on the carriage guides 7 in a manner such that it is slideable in the axial direction of the carriage guides 7. A carriage driving motor 11 such as a DC motor or step motor, which forms printing head driving means, is coupled by means of a driving wire 14 to the carriage 9. Therefore, as the carriage driving motor 11 is rotated, the carriage 9 is reciprocated in the axial direction of carriage guides 7. A dot impact type printing head 13 incorporating a number of electromagnet units (not shown) is mounted on the carriage 9. According to the printing data, the printing head 13 selectively drives the electromagnet units. As a result, the printing wires (not shown) corresponding to the electromagnet unit thus driven are operated, so that the printing data are printed in dot matrix form.

A ribbon cassette 15 is detachably mounted on the frames. A printing ribbon 17 is incorporated folded up in the ribbon cassette 15. The part of the printing ribbon 17 which is located between the two arms 15*a* and 15*b* of the ribbon cassette is extended substantially over the entire printing line of the printing sheet and parallel to the printing line. A ribbon driving roller and a supporting roller (not shown), which are abutted against each other, are rotatably supported in the ribbon cassette 15. The ribbon driving roller is coupled to a ribbon driving motor 23 such as a DC motor which forms ribbon driving means. As the printing ribbon 17 is held between the ribbon driving roller and the supporting roller, the ribbon 17 is moved in the direction of the arrow in FIG. 1 as the ribbon driving motor 23 rotates. The printing ribbon 17 extended along the printing line of the printing sheet 5 is guided by a guide pin 25 on the carriage 9 in such a manner that it is set apart from the printing sheet 5, and then moved toward the arm 15*b*.

Figure 2:
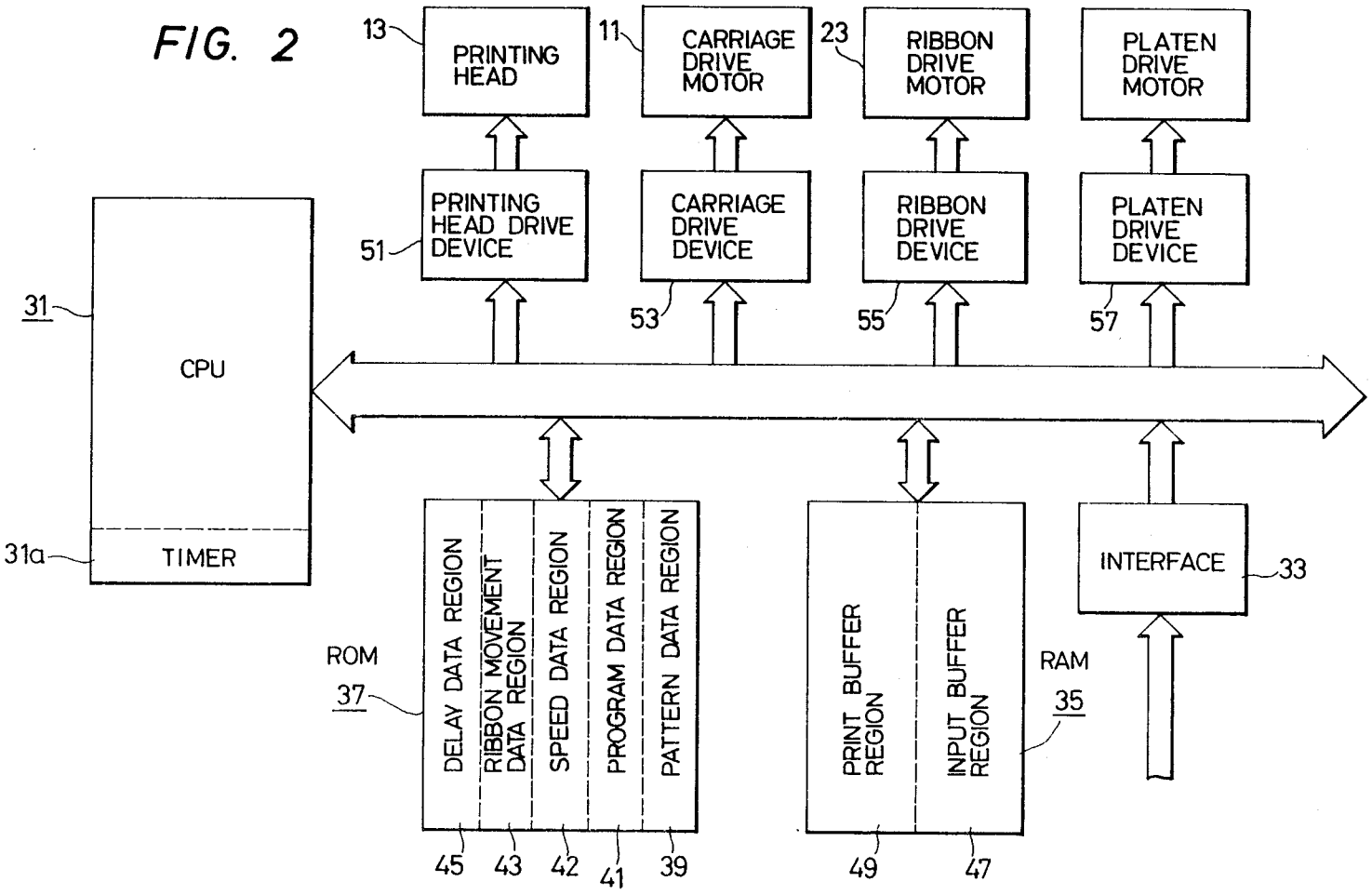
FIG. 2 is an electrical block diagram outlining the control system of the printer.

FIG. 2 outlines the control system of the printer 1 thus constructed. According to FIG. 2, an external unit (not shown) is connected through an interface 33 to a central processing unit (hereinafter referred to as a "CPU") 31. Various data such as printing data and printing instruction data are inputted to the CPU 31.

A ROM (read-only memory) 37 and a RAM (random access memory) 35 are connected to the CPU 31. The ROM 37 includes a pattern data region 39, a program data region 41, a speed data region 42, a ribbon movement data region 43, and a delay data region 45. Dot pattern data corresponding to various printing data such as characters and figures have been stored in the pattern data region 39. Various program data such as for instance a program for moving the printing ribbon 17 at predetermined speed in association with the forward movement or backward movement of the printing head 13 in a high density printing mode or high-speed printing mode have been stored in the program data region 41. First speed data for moving the printing head 13 at a low speed in the high-density printing mode, and second speed data for moving the printing head 13 at a high speed in the high-speed printing mode have been stored in advance in the speed data region 42. Ribbon movement data for moving the printing ribbon 17 at suitable speeds in association with the forward movement or backward movement of the printing head 13, in the high-density printing mode or high-speed printing mode, have been stored in advance in the ribbon movement data region 43. In the high-density printing mode, the ribbon movement data is so determined that the printing ribbon 17 is moved slightly in a direction opposite the forward movement of the printing head 13, and when the printing head 13 moves backward, the printing ribbon 17 is moved faster than the printing head. In the high-speed printing mode, the ribbon movement data is so determined that the printing ribbon 17 is moved slightly when the printing head 13 moves forward and when the head 13 moves backward, the printing ribbon 17 is moved slower than the printing head 13. Delay data, on the time td required for starting the carriage driving motor 11 after the start of the ribbon driving motor 23 in the high-density printing mode, has been stored in advance in the delay data region 45. The time td is so determined that, when the printing head 13 starts the printing operation with its speed reaching a predetermined value, the speed of movement of the printing ribbon 17 is higher than the speed of movement of the printing head 13. More specifically, $$td > t2 - t1$$

where t1 is the rise time required for the speed of the printing head 13 to reach a predetermined value, and t2 is the time required for the speed of the printing ribbon 17 to reach a predetermined value. Since the speed of the printing ribbon 17 is higher than the speed of the printing head 13, $t2 > t1$.

The RAM 35 includes an input buffer region 47 and a print buffer region 49. Various data such as printing data and printing instruction data inputted by the external unit are stored in the input buffer region 47. Dot pattern data obtained by accessing the pattern data region according to the printing data transferred from the input buffer region 47 are stored in the print buffer region 49.

The CPU 31 has a timer 31*a*, which measures the aforementioned predetermined time td. A printing head driving device 51 is connected to the CPU 31. The driving device 51 selectively drives the electromagnet units of the printing head 13 according to the dot pattern transferred from the print buffer region 49. The CPU 31 is further connected to a carriage driving device 53.

In the high-density printing mode, the carriage driving device 53 drives the carriage driving motor 11 according to the first speed data stored in the speed data region 42 to reciprocate the printing head 13 at low speed. The CPU 31 is further connected to a ribbon driving device 55. In the high-density printing mode, the ribbon driving device 55 drives the ribbon driving motor 23 according to the ribbon movement data stored in the ribbon movement data region 43 when the head 13 moves forward, thereby moving the ribbon slightly in a direction opposite to the forward direction of the head 13. When the printing head 13 moves backward, the device 55 drives the ribbon driving motor 23 according to the ribbon movement data stored in the ribbon movement data region 43, thereby moving the ribbon in the backward direction of the head 13 and at a speed higher than the speed of the printing head 13.

In the high-speed printing mode when the head 13 moves forward, the ribbon driving device 55 drives the ribbon driving motor 23 according to the ribbon movement data stored in the ribbon movement data region 43, thereby moving the ribbon slightly in the direction opposite to the forward direction of the head 13. When the printing head moves backward, the device 55 drives the ribbon driving motor 23 according to the ribbon movement data stored in the ribbon movement data region 43, thereby moving the ribbon in the backward direction and at a speed lower than the speed of the head 13. A platen driving device 57 is connected to the CPU 31. The platen driving device 57 drives the platen driving motor according to a sheet supply signal provided by the CPU 31, thereby feeding the printing sheet 5 wound on the platen 3.

The ribbon moving operation of the printer 1 thus constructed will be described with reference to FIG. 3, and the parts (A) and (B) of FIG. 4.

Figure 3:
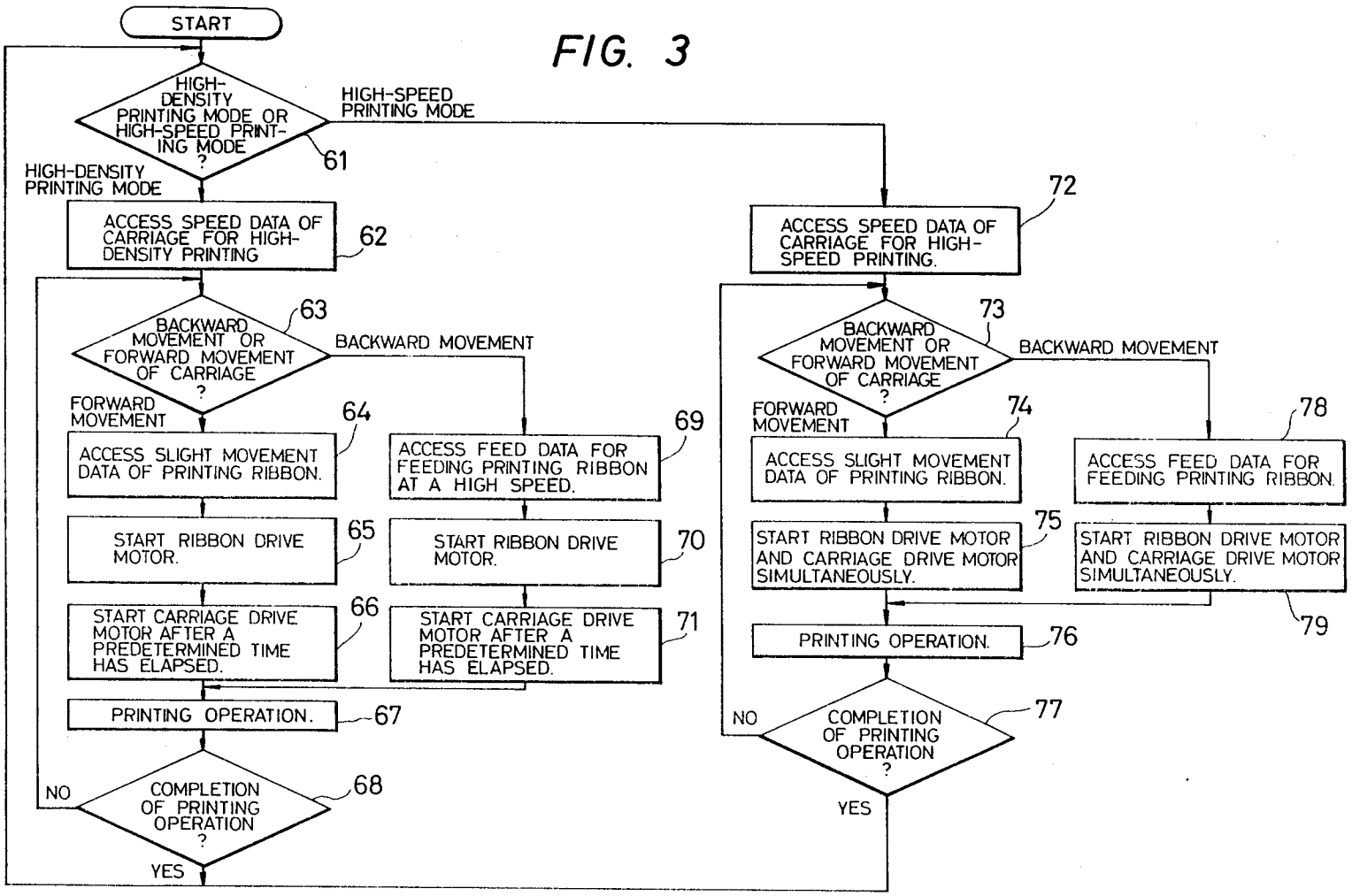
FIG. 3 is a flow chart for describing the ribbon moving operation of the printer.
Figure 4A:
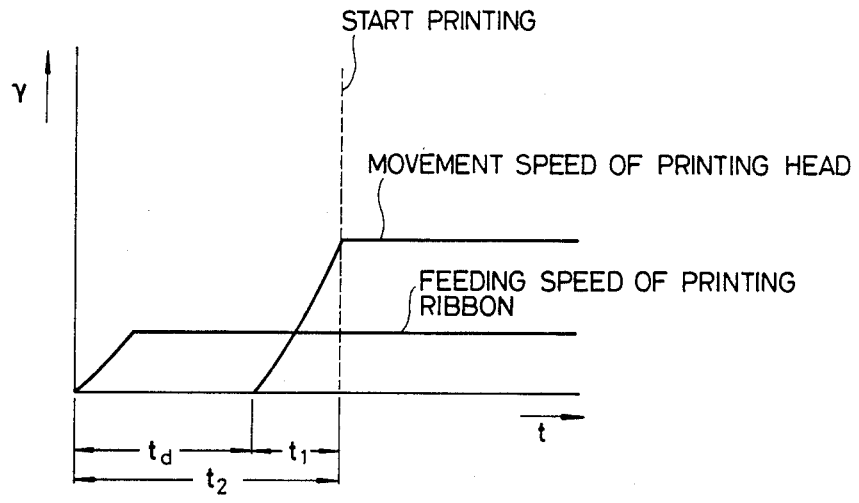
FIGS. 4A and 4B are explanatory diagrams indicating the timing of driving a carriage driving motor and a ribbon driving motor in a high-density printing mode according to the prior art and according to the present invention.
Figure 4B:
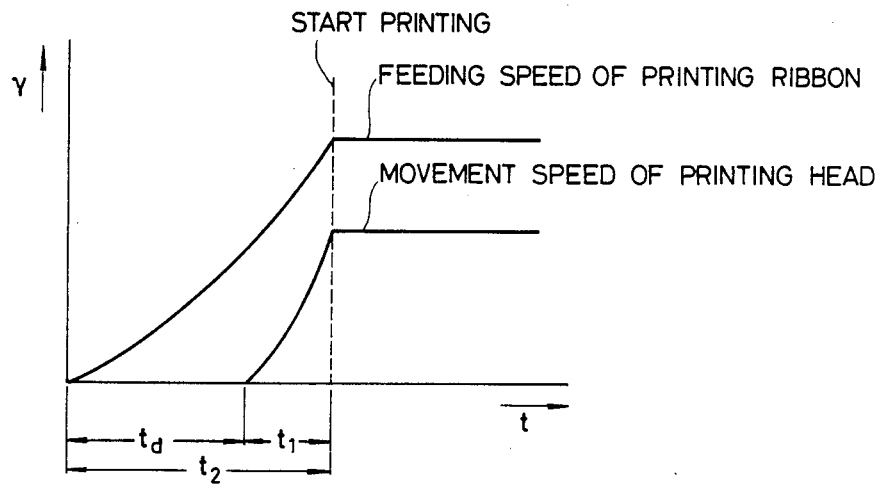

FIG. 3 shows the ribbon moying operation, and the parts (A) and (B) of FIG. 4 indicate the timing of starting the carriage driving motor 11 and the ribbon driving motor 23.

First, the ribbon moving operation in the high-density printing mode will be described. In Step 61, the CPU 31 determines whether the selected printing mode is the high-density printing mode or the high-speed printing mode. Assume first that the high-density printing mode has been selected. Therefore, in Step 62, the CPU 31 makes access to the speed data region 42 for the first speed data in order to move the printing head 13 at low speed. In Step 63, the CPU 31 determines whether the printing operation should be carried out in association with the forward movement of the printing head 13 or in association with the backward movement of the printing head 13. In general, initially the printing operation is carried out in association with the forward movement of the printing head 13. Access is made to the ribbon movement data region 43 for the ribbon movement data to slightly move the printing ribbon 17 in the forward movement of the printing head 13. In Step 65, the ribbon driving motor 23 is started according to the ribbon movement data, the printing ribbon 17 is moved slightly in the direction opposite to the movement of the printing head 13, and the timer 31*a* is started. In Step 66, the CPU 31 compares the count value of the timer 31*a* thus started with delay data stored in the delay data region 45, and drives the carriage driving motor 11 when the two data coincide and the aforementioned predetermined time td has passed. As a result of this, the printing head 13 on the carriage 9 is moved forward along the printing line (cf. the part (A) of FIG. 4). As the printing ribbon 17 is moved slightly in the direction opposite to the movement of the printing head 13 before the forward movement of the printing head 13, the difficulty that the printing ribbon 17 is slackened when the forward movement of the printing head 13 is started is prevented; that is, the printing ribbon 17 is maintained tightened. In Step 67, when the speed of movement of the printing head 13 reaches the predetermined value after the start of the carriage driving motor 11, the CPU 31 selectively drives the electromagnet units of the printing head 13 according to the dot patterns transferred from the print buffer region 49 so that printing data of one line are printed. In Step 68, the CPU 31 determines whether or not all the printing operations have been accomplished. When the result of the determination is "YES," Step 61 is effected again. If the result of the determination is "NO," the operation is returned to Step 63.

Figure 5:
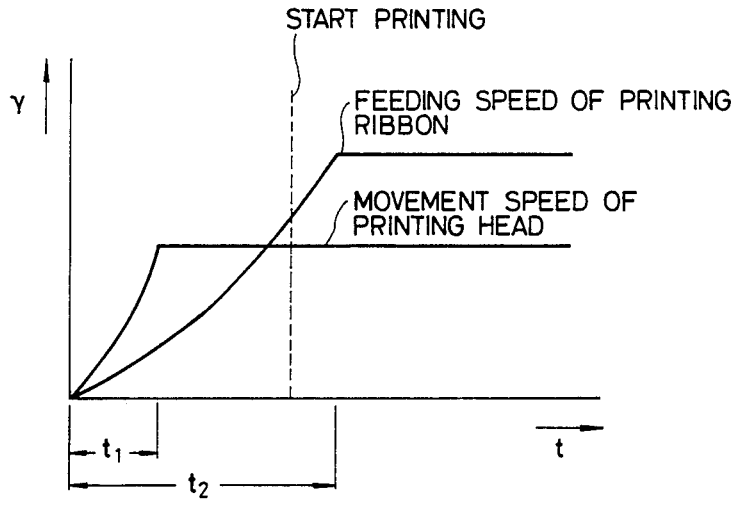
FIG. 5 is a diagram for describing one modification of the present invention.
Figure 6:
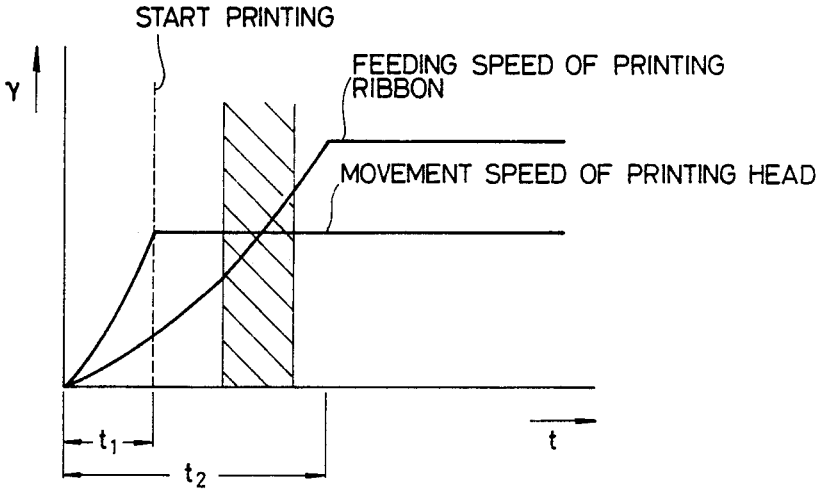
FIG. 6 is a diagram for describing a conventional printing device.

In the case where the printing operation is carried out in association with the backward movement of the printing head 13, in Step 69 the CPU 31 makes an access to the ribbon movement data region 43 for the ribbon movement data to move the ribbon 17 at a speed in the backward direction higher than the speed of the printing head 13. Subsequently, in Step 70, the CPU starts driving the ribbon driving motor 23 according to the ribbon movement data thus obtained so that the printing ribbon 17 is moved in the direction of movement of the printing head at a speed higher than the speed of movement of the printing head 13, while the timer 31*a* is started. After the start of the ribbon driving motor 23 in Step 71, the CPU 31 compares the count value of the timer 31*a* with the delay data stored in the delay data region 45, and start the carriage driving motor 11 when the two data coincide with each other, so that the printing head is moved backwardly along the printing line (cf. the part (B) of FIG. 4). When the speed of movement of the printing head 13 has reached the predetermined value, the CPU 31 performs the printing operation (Step 67). As is apparent from the above description, when the speed of movement of the printing head 13 has reached the predetermined value, the printing ribbon 17 is moved faster than the printing head. Therefore, as shown in FIG. 5, the speeds of the ribbon and the head will never coincide with each other, and in the printing operation the unused part of the printing ribbon is moved to the printing position.

The ribbon moving operation in the high-speed printing mode will be described below.

If the high-speed printing mode has been selected, in Step 72, the CPU 31 makes an access to the speed data region 42 for the second speed data to move the printing head 13 at high speed. Subsequently, in Step 73, the CPU 31 determines whether the printing head 13 is moved forwardly or backwardly. In general, the printing operation is initially carried out in association with the forward movement of the printing head 13. Therefore, in Step 74, the CPU 31 takes an access to the ribbon movement data region 43 to move the ribbon 17 slightly. Subsequently, in Step 72, the CPU 31 starts the carriage driving motor 11 according to the second speed data obtained in Step 72 and the ribbon driving motor 23 according to the ribbon movement data obtained in Step 74. The printing head 13 is thus moved forwardly along the printing line, while the printing ribbon is moved slightly in the direction opposite to the direction of movement of the printing head 13. When the speed of the printing head 13 has reached the predetermined value thereafter, in Step 76, the CPU 31 drives the printing head 13 forward, and the printing data are printed in dot matrix form according to. the dot pattern data transferred from the print buffer region 49. In Step 77, the CPU 31 determines whether or not all the printing operations have been accomplished. When the result of determination is "YES," Step 61 is effected again. If the result of the determination is "NO," Step 73 is carried out.

When the printing operation is carried out in association with the backward movement of the printing head 13, in Step 78, the CPU 31 makes an access to the ribbon movement data region to move the printing ribbon 17 at a speed lower than the speed of the printing head 13. In Step 79, the CPU 31 starts the carriage driving motor 11 according to the second speed data obtained in Step 72 and the ribbon driving motor 23 according to the ribbon movement data obtained in Step 78. As a result, the printing head 13 is moved backwardly along the printing line at high speed, while the printing ribbon is moved in the same direction as the printing head 13 at a lower speed than the head. When the speed of movement of the printing head 13 has reached the predetermined value, Step 76 is effected by the CPU 31 to carry out the printing operation. In this case, the printing ribbon 17 is moved at the speed lower than the speed of movement of the printing head 13 and, therefore, the printing operation is carried out by using the used part of the printing ribbon 17. Therefore, the printed characters are low in quality; however, in the high-speed printing mode, the low quality of the printed characters does not matter as much.

In summary, in the high-density printing mode when the printing operation is carried out as the printing head 13 moves forward, the carriage driving motor 11 is started a predetermined time td after the start of the ribbon driving motor 23. Therefore, by slightly running the printing ribbon 17 in the direction opposite to the direction of movement of the printing head 13, the printing operation can be performed while the printing ribbon 17 extended along the printing line is always tightened. This prevents low quality printed characters because of slackened printing ribbon 17. When the printing head 13 moves backward and the printing ribbon 17 is moved in the same direction as and at higher speed than the printing head 13, the carriage driving motor 11 is started a predetermined time td after the start of the ribbon driving motor 23. Therefore, at the start of the printing operation, the printing ribbon 17 is moved faster than the printing head 13 and an unused part of the printing ribbon 17 is always at the printing position. This eliminates unclear character printed by using the used part of the printing ribbon 17.

When the printing operation is carried out in association with the backward movement of the printing head 13 in the high-density printing mode, the carriage driving motor 11 is started a predetermined time td after the start of the ribbon driving motor 23. When the speed of the printing head 13 reaches the predetermined value to start the printing operation, the speed of the printing ribbon 17 is made higher than the speed of movement of the printing head 13 so that the unused part of the printing ribbon is at the printing position at all times. However, the control may be so modified that, in the case where the ribbon driving motor 23 and the carriage driving motor 11 are started simultaneously as shown in FIG. 5, the printing operation is started when the speed of movement of the printing ribbon 17 becomes higher than the speed of movement of the printing head 13.

As is apparent from the above description, according to the invention, when the direction of printing head coincides with the direction of the printing ribbon, and the printing ribbon is moved faster than the printing head, the printing operation is started so that the same part of the printing ribbon is not repeatedly used. Therefore, the invention provides a printing device with which characters can be clearly printed at all times.

The present invention has been disclosed in terms of preferred embodiments. The scope of the invention is not limited thereto but is defined by the appended claims and their equivalents.

What is claimed is:

1. A printing device, comprising:
a printing ribbon;
a printing head for impacting the ribbon incident to a printing operation;
printing head driving means for reciprocating the printing head along a line in first and second directions, wherein said head reciprocates at a first speed;
ribbon driving means for moving the ribbon only in said second direction at a second speed; and
control means for starting the printing operation according to a first parameter, wherein the first parameter includes the printing head moving in the second direction and the second speed being greater than the first speed.

2. A printing device according to claim 1, wherein, said control means starts said printing operation according to a second parameter; wherein said second parameter includes the printing head moving in the first direction and the second speed being less than the first speed.

3. A printing device according to claim 2, wherein said control means starts said printing operation according to a third parameter; and wherein the third parameter includes the printing head moving in the second direction and the second speed being less than the first speed.

4. A method for operating a printing device comprising the steps of:
(a) selecting either a first direction or a second direction for a printing head to move along a line;
(b) if said first direction is selected, the step of accessing first movement data for moving the ribbon at a second speed;
(c) after step (b), starting a ribbon driving means for driving the ribbon only in the second direction at said second speed;
(d) a first predetermined time period after step (c), starting a printing head driving means for driving the printing head in said first direction at a first speed faster than said second speed;

(e) after step (d), and when the ribbon is moving, starting a printing operation whereby the printing head impacts the ribbon;

(f) selecting either to repeat step (a) or to stop the printing device;

(g) if said second direction is selected, the step of accessing second movement data for moving the ribbon at a third speed, wherein the third speed is faster than the first speed;

(h) after step (g), starting the ribbon driving means for driving the ribbon only in the second direction at said third speed;

(i) the first predetermined time period after step (h), starting the printing head driving means for driving the printing head in the second direction at the first speed;

(j) after step (i), starting the printing operation whereby the printing head impacts the ribbon; and (k) selecting either to repeat step (a) or to stop the printing device.

* * * * *